US009299207B2

(12) United States Patent
Guo et al.

(10) Patent No.: US 9,299,207 B2
(45) Date of Patent: Mar. 29, 2016

(54) PAPER-CURRENCY DISPENSING BOX

(71) Applicant: GRG Banking Equipment Co., Ltd., Guangzhou, Guangdong (CH)

(72) Inventors: Zhijian Guo, Guangzhou (CH); Qingning Zeng, Guangzhou (CH); Yun Lei, Guangzhou (CH)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/442,059

(22) PCT Filed: Jul. 2, 2013

(86) PCT No.: PCT/CN2013/078627
§ 371 (c)(1),
(2) Date: May 11, 2015

(87) PCT Pub. No.: WO2014/089962

PCT Pub. Date: Jun. 19, 2014

(65) Prior Publication Data

US 2015/0302680 A1 Oct. 22, 2015

(30) Foreign Application Priority Data

Dec. 11, 2012 (CN) ..... 2012 1 0532429

(51) Int. Cl.
*G07D 11/00* (2006.01)

(52) U.S. Cl.
CPC ..... *G07D 11/0012* (2013.01); *G07D 11/00* (2013.01)

(58) Field of Classification Search
CPC ..... G07D 11/0009; G07D 11/0012; G07D 11/0024; G07D 11/00; B65H 1/04; B65H 3/06; B65H 5/06; B65H 29/40; B65H 2701/1912; G07F 19/203
USPC ..... 232/1 D, 15, 16; 194/206, 350; 235/379; 902/13; 221/197; 271/10.1, 10.09
See application file for complete search history.

(56) References Cited

U.S. PATENT DOCUMENTS 4,431,178 A * 2/1984 Kokubo ..... B65H 29/40 271/187
4,708,335 A * 11/1987 Wake ..... B65H 29/40 271/187

(Continued)

FOREIGN PATENT DOCUMENTS

CN 101159041 A 4/2008
CN 101211479 A 7/2008

(Continued)

OTHER PUBLICATIONS

Written Opinion of the International Authority dated, Oct. 13, 2013, from corresponding International Application No. PCT/CN2013/078627.

(Continued)

*Primary Examiner* — William Miller
(74) *Attorney, Agent, or Firm* — Wolf, Greenfield & Sacks, P.C.

(57) ABSTRACT

A banknote dispenser of a financial self-service device is provided for storing, separating and discharging banknotes. The banknote dispenser is provided with a housing, a banknote separating mechanism for separating a stack of banknotes piece by piece, a banknote pressing mechanism for pushing the stack of banknotes towards the banknote separating mechanism, and a limiting block for ensuring that the stack of banknotes are separated piece by piece and configured to allow the ends of the stack of banknotes to form an acute angle state when being separated. A banknote picking wheel and a banknote separating wheel assembly of the banknote separating mechanism are each provided with a one-way bearing, and at least one guide rib is arranged on the surface of the limiting block in the stacking direction of the banknotes, and the height of the guide rib reduces progressively in the direction towards the banknote outlet.

10 Claims, 9 Drawing Sheets

(56) References Cited

U.S. PATENT DOCUMENTS

| | | | | |
|---|---|---|---|---|
| 8,430,395 | B2 * | 4/2013 | Peters | B65H 1/04 194/206 |
| 8,827,152 | B2 * | 9/2014 | Ross | G06K 7/0008 235/379 |
| 2004/0188914 | A1 * | 9/2004 | Chang | B65H 3/063 271/10.1 |
| 2007/0176349 | A1 * | 8/2007 | Gerlier | B65H 1/04 271/10.03 |
| 2008/0007146 | A1 * | 1/2008 | Hillman | G07D 11/0009 312/183 |
| 2008/0156614 | A1 | 7/2008 | Park et al. | |
| 2011/0036680 | A1 | 2/2011 | Lin | |
| 2011/0101594 | A1 * | 5/2011 | Colston | B65H 5/34 271/3.04 |
| 2011/0186488 | A1 * | 8/2011 | Nordin | B65H 29/40 209/534 |
| 2014/0166684 | A1 * | 6/2014 | Miller | B65H 3/446 221/1 |
| 2014/0238251 | A1 | 8/2014 | Zhang et al. | |

FOREIGN PATENT DOCUMENTS

| | | | |
|---|---|---|---|
| CN | 102496206 | A | 6/2012 |
| CN | 102737438 | A | 10/2012 |
| CN | 202563587 | U | 11/2012 |
| CN | 103035062 | A | 4/2013 |
| CN | 203025836 | U | 6/2013 |
| CN | 203025837 | U | 6/2013 |
| CN | 203025838 | U | 6/2013 |
| CN | 203025839 | U | 6/2013 |
| DE | 2825086 | A1 | 1/1979 |
| EP | 2458567 | A1 | 5/2012 |
| JP | H07215518 | A | 8/1995 |
| JP | 2008186314 | A | 8/2008 |
| JP | 2010173759 | A | 8/2010 |
| JP | 2011241068 | A | 12/2011 |
| KR | 1006084420000 | B1 | 7/2006 |
| KR | 10-2007-0029907 | A | 3/2007 |
| KR | 20-0440186 | Y | 5/2008 |
| KR | 20120041465 | A | 5/2012 |

OTHER PUBLICATIONS

International Search Report dated Oct. 10, 2013from corresponding International Application No. PCT/CN2013/078627.

International Search Report, dated Sep. 3, 2013, from corresponding or related International Application No. PCT/CN2013/078627.

Chinese Office Action, dated Aug. 4, 2014, from corresponding Chinese Application No. 201210532429.6.

Written Opinion, dated Oct. 10, 2013, from corresponding International Application No. PCT/2013/078627.

Extended European Search Report, dated Dec. 10, 2015, from corresponding European Application No. 13862084.4.

* cited by examiner

PAPER-CURRENCY DISPENSING BOX

This application is the national phase of International Application No. PCT/CN2013/078627, filed on Jul. 2, 2013, which claims the priority benefit of Chinese Patent Application No. 201210532429.6 titled "BANKNOTE DISPENSER", filed with the Chinese State Intellectual Property Office on Dec. 11, 2012, which applications are hereby incorporated by reference to the maximum extent allowable by law.

TECHNICAL FIELD

The present application relates to the technique for storing and separating sheet-type medium, and particularly to a banknote dispenser of a financial self-service equipment for storing, separating and dispensing banknotes.

BACKGROUND

Self-service equipment is an important equipment for financial institutes, and has a strict management requirement. The boundary dimension, usage stability, and safe reliability in management of the operation equipment are important matters to be considered by the providers of the self-service equipment. A banknote dispenser for storing, separating and dispensing banknotes is an important module of the financial self-service equipment, and the boundary dimension, operation stability, and safe reliability in operation of the banknote dispenser is related to the user experience of the entire financial self-service equipment.

The existing banknote dispenser has following features. 1. In a banknote separating mechanism, a banknote separating wheel assembly and a banknote picking wheel assembly are partially coated with rubber. The banknote separating mechanism separates out one sheet of banknote when the banknote separating wheel assembly rotates once, thus the banknote separating wheel assembly rotates continuously to realize continuous banknote separating. 2. A surface of a limiting block placed in front of the banknotes flushes with the stacking direction of a whole stack of banknotes. 3. The banknote dispenser cooperates with parts of the self-service equipment to activate the banknote dischargeable state. 4. A banknote pressing board of the banknote dispenser is tightly fastened via a buckle and can be loosened when the buckle is pressed manually.

The above banknote dispenser has the following problems. 1. The outer diameter of the banknote separating wheel assembly of the banknote separating mechanism is restricted by the length of the banknote in the banknote separating direction. The outer perimeter of the banknote separating wheel assembly is required to be greater than the length of the banknote in the banknote separating direction. For example, if the banknotes are separated in the longitudinal direction, and the length of the banknote is 180 mm, then the diameter of the banknote separating wheel assembly should be greater or equal to 57 mm based on calculation. Such banknote dispensing mechanism has a large dimension and can directly cause the banknote dispenser to have a large dimension. 2. The ends, to be separated, of the whole stack of stored banknotes are aligned, which causes a poor stability in the piece-by-piece banknote separating process for the banknote dispenser. 3. When the banknote dispenser has not been assembled to the equipment, the cooperation between the banknote dispenser and the parts of the equipment can be simulated with simple tools, to allow the banknote dispenser to be in the banknote dischargeable state, which may result in banknotes in the banknote dispenser being stolen, therefore the banknote dispenser has a low security. 4. It is required to perform a procedure of pressing the buckle manually to loose the banknote pressing board, if the operator misses this procedure, the banknote pressing board will be still in a fastened state, which directly results in an invalid banknote separation and the banknote dispenser being failing to dispense banknotes. Such banknote dispenser has a low operation reliability and a poor fault tolerance.

SUMMARY

A banknote dispenser is provided according to the present application, which has a small dimension and can separate banknotes stably, so as to address the technical issues that the conventional banknote dispenser has an oversized volume and the banknote separation thereof is unstable.

For realizing the above objects, a banknote dispenser is provided according to the present application, which includes:

a housing, including an upper cover and a base case, one end of the upper cover being movably connected to one end of the base case via a rotating shaft, and a space for accommodating other components and banknotes being formed in the case that the upper cover is closed on the base case, and the housing being provided with a banknote outlet for discharging the banknotes;

a banknote separating mechanism located near the banknote outlet, and including a banknote picking wheel assembly configured to be placed on a surface of the banknotes, a banknote separating wheel assembly and a reverse wheel which are configured to be placed at an end of the banknotes and to separate a stack of banknotes piece by piece, and a banknote separating base plate configured to install required components, wherein the banknote picking wheel assembly includes a banknote picking wheel having a rubber surface, a banknote picking wheel shaft configured to rotate the banknote picking wheel, and a first one-way bearing configured to assemble the banknote picking wheel and the banknote picking wheel shaft, and the banknote separating wheel assembly includes a banknote separating rubber wheel in an interference fit with the reverse wheel, a banknote separating wheel shaft configured to rotate the banknote separating rubber wheel, and a second one-way bearing configured to assemble the banknote separating rubber wheel and the banknote separating wheel shaft;

a banknote pressing mechanism, including a banknote pressing board placed in the base case and configured to stack up the stack of banknotes, a guide shaft of the banknote pressing board, and a spring configured to enable the banknote pressing board to always press against the banknote picking wheel assembly of the banknote separating mechanism; and a limiting block, arranged on one end where the stack of banknotes is separated out, at least a guide rib being provided on a surface of the limiting block in a banknote stacking direction, and a height of the guide rib being decreased progressively in the direction towards the banknote outlet.

For solving the problem that the banknote pressing board is required to be manually unlocked when the banknote dispenser is used, preferably, the banknote dispenser also includes a mistake-proof mechanism for a buckle of the banknote pressing board, which includes a buckle configured to retain the banknote pressing board at the lowest position of the base case, and the buckle is movably installed in the housing via a rotating shaft and is provided with a torsion spring configured to allow the buckle to reset automatically.

Furthermore, a buckle trigger mechanism is arranged on the upper cover at a position corresponding to the buckle.

Furthermore, the buckle trigger mechanism includes a rib arranged on an inner side wall of the upper cover at a position corresponding to the buckle.

For ensuring the security of the banknotes in the banknote dispenser, the banknote dispenser is not allowed to freely discharge banknotes when the banknote dispenser is disengaged from the financial service equipment. Preferably, the banknote separating mechanism further includes a locking mechanism, the locking mechanism includes a gear locking device configured to selectively lock the banknote picking wheel assembly, and a pulling device configured to control the gear locking device to lock and unlock the banknote picking wheel, the gear locking device includes an elongated gear locking sheet, an fastener is provided at an end of the elongated gear locking sheet, and the elongated gear locking sheet is provided with an elongated hole acting as a stroke limiting hole for the elongated gear locking sheet, the guide shaft passes through the stroke limiting hole to movably assemble the elongated gear locking sheet and the banknote separating base plate, and the elongated gear locking sheet is configured to keep the engaging trend between the fastener and the banknote picking mechanism through a gear locking tension spring.

Preferably, the pulling device includes a pull arm assembly and a driving assembly, the pull arm assembly includes an elongated pull arm, one end of the elongated pull arm is provided with a pull rod in selective contact with the elongated gear locking sheet, and a bearing in rolling contact with the driving assembly is provided at another end of the elongated pull arm via a small shaft.

Preferably, the driving assembly includes a lock cylinder relatively fixed to the housing, and a cam configured to rotate together with the lock cylinder, an arc-shaped boss is provided on an outer surface of the cam, the arc-shaped boss has one point with a maximum radius and another point with a minimum radius, and the lock cylinder is configured to drive the cam to rotate, to make the bearing move reciprocally between the point with the maximum radius and the point with the minimum radius of the boss.

Preferably, the elongated pull arm is provided with a tension spring, and the tension spring has one end fixed to the elongated pull arm, and another end relatively fixed to the housing.

To prevent the upper cover from being illegally opened, preferably, an upper cover locking mechanism is arranged on one end of the upper cover where the upper cover engages with or disengages from the base case, and is configured to lock the upper cover and the base case and to maintain the upper cover and the base case as an integral.

To ensure that the piece-by-piece separated banknote is smoothly discharged out of the housing, preferably, the banknote separating mechanism also includes a banknote conveying wheel and a pinch roller which are assembled in interference fit and configured to deliver out the piece-by-piece separated banknote, and the banknote conveying wheel and the pinch roller are located on one side of the banknote separating wheel assembly where the banknotes are delivered out.

Compared with the conventional technology, the banknote dispenser according to the present application has the following advantages.

1. The banknote picking wheel assembly and the banknote separating wheel assembly of the banknote separating mechanism adopt a structure with a built-in one-way bearing, and the banknote picking wheel assembly and the banknote separating wheel assembly can both rotate freely in the banknote discharging direction, thereby preventing the rubber wheel from generating a sliding friction force on the banknotes when the banknotes are discharged. A full circle rubber structure is used, which allows an inching control of the banknote picking wheel assembly and the banknote separating wheel assembly to send banknotes between the banknote conveying wheel and the pinch roller, and the outer diameter of the banknote separating wheel assembly is not restricted by the length of the banknote and can be designed smaller, thus the space occupied by the banknote separating mechanism is greatly reduced, and the banknote dispenser has a small boundary dimension.

2. A guide rib is provided on the surface of the limiting block, to make the stack of banknotes form an acute angle state before the banknotes are separated, which facilitates separating the banknotes, and enables the banknote dispenser to separate banknotes more effectively and stably.

3. A locking mechanism is provided to drive a series of mechanical transmission to allow the banknote dispenser to be in a banknote dischargeable state, and the locking mechanism is controlled by the only one matched key, hence the banknote dispenser has a high security.

4. A mistake-proof mechanism for the buckle of the banknote pressing board is provided, thus when the upper cover of the banknote dispenser is closed, the buckle is jointly rotated to be disengaged from the banknote pressing board, which avoids the situation that the banknote pressing board is always in the fastened state in the case that the operator misses the procedure of pressing the buckle, hence the banknote dispenser has a high operation reliability and a good fault tolerance.

BRIEF DESCRIPTION OF THE DRAWINGS

The present application is further described in conjunction with drawings and embodiments.

DETAILED DESCRIPTION

Technical solutions of embodiments of the present application are described clearly and completely in conjunction with drawings hereinafter.

Figure 1:
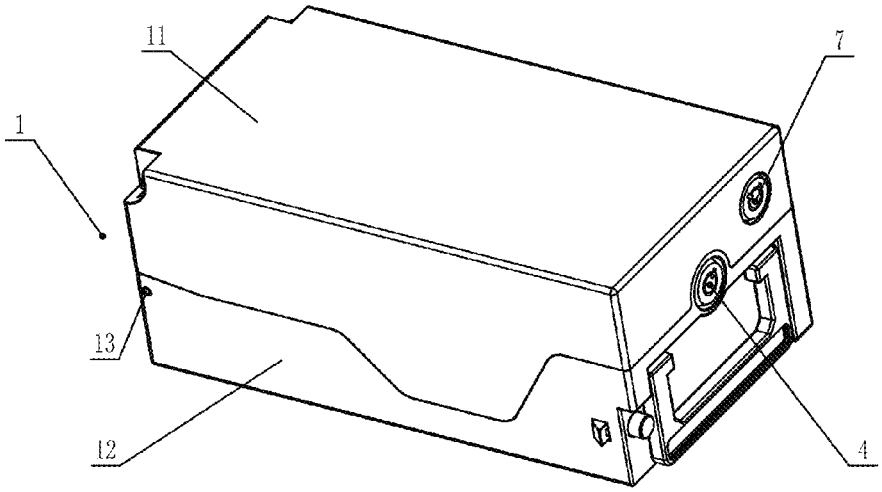
FIG. 1 is an overall schematic view of a banknote dispenser according to the present application.
Figure 2:
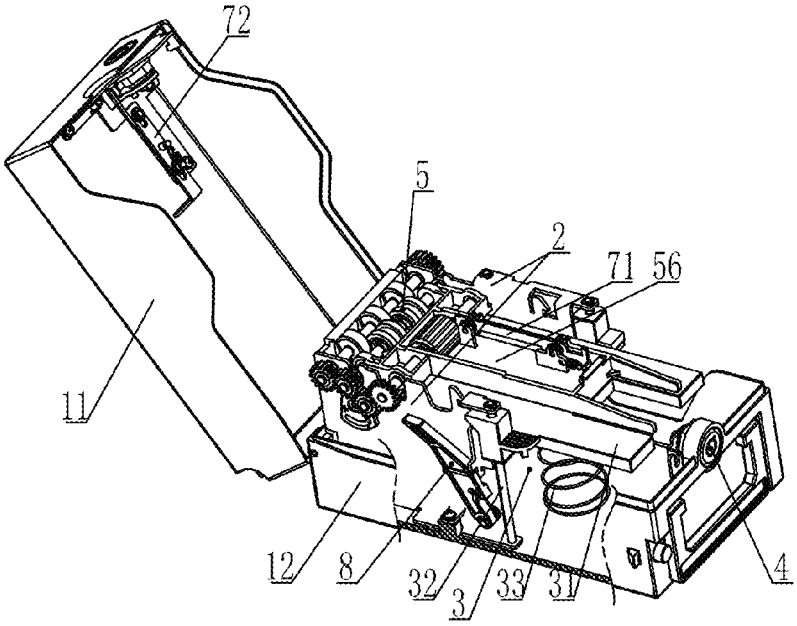
FIG. 2 is an overall schematic view of the banknote dispenser in FIG. 1 with an upper cover being opened.
Figure 3:
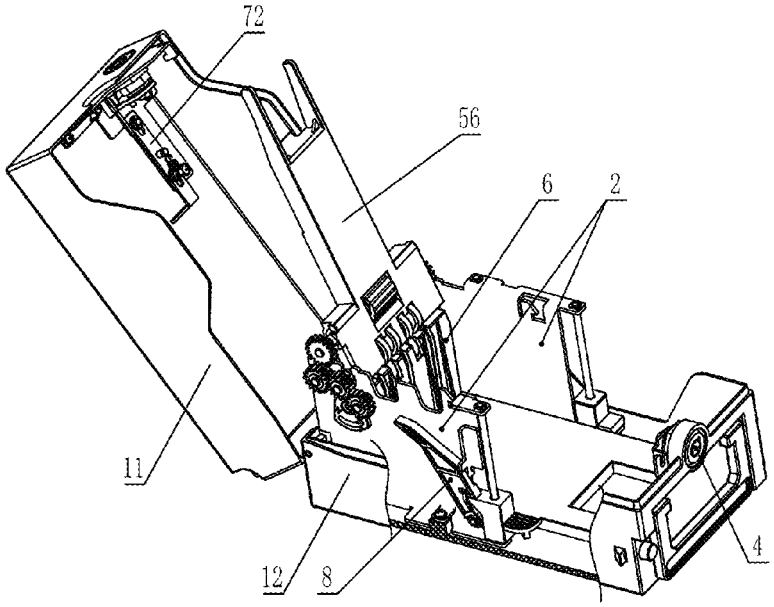
FIG. 3 is an overall schematic view of the banknote dispenser in FIG. 1 with the upper cover and a banknote separating base plate being opened at the same time.

Reference is made to FIGS. 1, 2 and 3. A banknote dispenser according to the present application includes a housing 1, an internal frame 2, a banknote pressing mechanism 3, an upper cover locking mechanism 4, a banknote separating mechanism 5, a limiting block 6, a locking mechanism 7, a mistake-proof mechanism 8 for a buckle of the banknote pressing board, and a necessary power mechanism. As shown in FIG. 1, the housing 1 includes an upper cover 11 and a base case 12, one end of the upper cover 11 is movably connected to one end of the base case 12 via an upper cover rotating shaft 13, and a space for accommodating other components and banknotes is formed when the upper cover 11 is closed on the base case 12. The housing 1 is provided with a banknote outlet for discharging the banknotes. The upper cover may rotate around the upper cover rotating shaft 13 to open and close the banknote dispenser. As shown in FIGS. 2 and 3, to facilitate arranging internal components in the housing, the internal frame 2 for installing other components is arranged in the housing, and the internal frame 2 is fastened onto an inner surface of a bottom of the base case 12 via bolts. As shown in FIG. 2, the banknote pressing mechanism 3 includes a banknote pressing board 31 placed inside the base case 12 and configured to stack up a stack of banknotes, a guide shaft 32 of the banknote pressing board 31, and a banknote pressing spring 33 which enables the banknote pressing board to always press against a banknote picking wheel assembly of the banknote separating mechanism. The guide shaft 32 is limitedly installed on the internal frame 2 via a split washer. The banknote pressing board 31 may move upwards along the guide shaft 32 under the action of the banknote pressing spring 33. The upper cover locking mechanism 4 is arranged on one end of the upper cover 11 where the upper cover 11 engages with and disengages from the base case 12, and is fixed to the base case 12 via a nut, and is configured to lock and unlock the upper cover 11. The banknote separating mechanism 5 is installed in the internal frame 2 near the banknote outlet, and is configured to separate the whole stack of stacked banknotes piece by piece. As shown in FIG. 3, the limiting block 6 is arranged on one end where the stack of banknotes are separated out and is fastened to the internal frame 2 via a bolt. As shown in FIG. 2, the locking device includes a gear locking device 71 and a pulling device 72. The gear locking device 71 is arranged on a banknote separating base plate 56 connected to the banknote separating mechanism 5, and the pulling device 72 is fixed to the upper cover 11 via a bolt. As shown in FIG. 2, the mistake-proof mechanism 8 for the buckle of the banknote pressing board is fixed to the internal frame 2 via a bolt.

Figure 4:
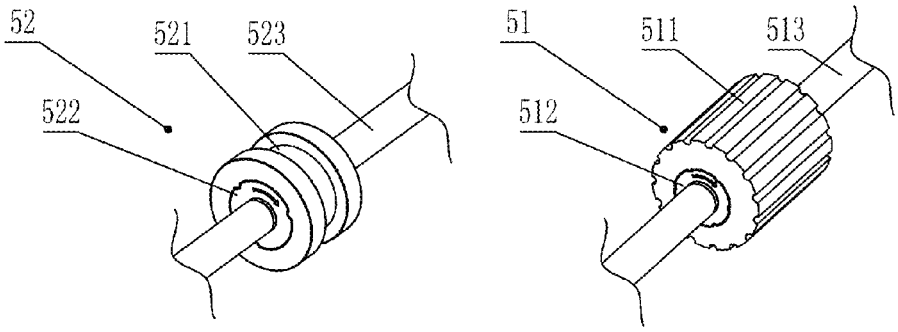
FIG. 4 is a perspective view showing a banknote separating wheel assembly and a banknote picking wheel assembly of a banknote separating mechanism of the banknote dispenser in FIG. 2.
Figure 5:
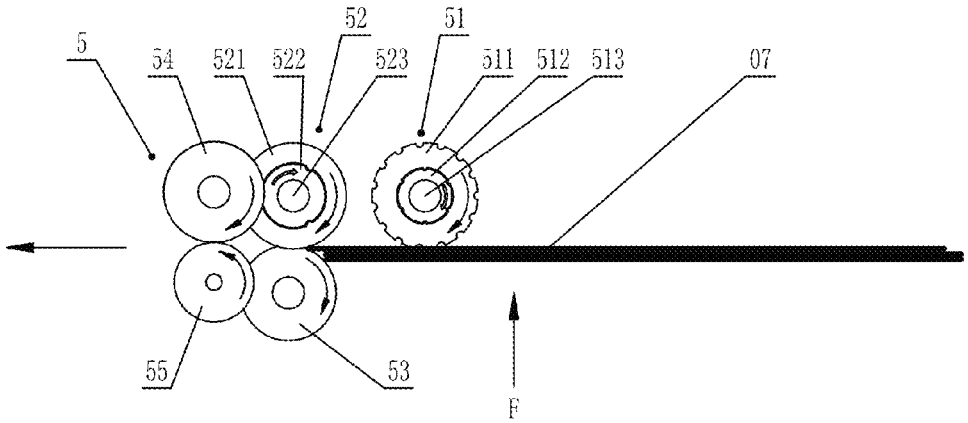
FIG. 5 is a schematic view showing the working principle of the banknote separating mechanism of the banknote dispenser in FIG. 2.

Reference is made to FIGS. 2, 4 and 5, which are the perspective views showing a banknote separating wheel assembly 51 and a banknote picking wheel assembly 52 of the banknote separating mechanism 5 of the banknote dispenser. The banknote separating mechanism is located near the banknote outlet and includes the banknote picking wheel assembly 51 placed on the surface of the banknote, the banknote separating wheel assembly 52 and a reverse wheel 53 which are placed at an end of the banknote and configured to separate the stack of banknotes piece by piece, and a banknote separating base plate 56 configured to install required components. The banknote picking wheel assembly 51 includes a banknote picking wheel 511 having a rubber surface, a banknote picking wheel shaft 513 configured to rotate the banknote picking wheel 511, and a first one-way bearing 512 configured to assemble the banknote picking wheel 511 and the banknote picking wheel shaft 513. The banknote picking wheel 511 wraps the outer surface of the one-way bearing 512, the banknote picking wheel shaft 513 passes through the center hole of the one-way bearing 512, and the banknote picking wheel 511 is freely rotatable in the banknote discharging direction. The banknote separating wheel assembly 52 includes a banknote separating rubber wheel 521 in an interference fit with the reverse wheel 53, a banknote separating wheel shaft 523 configured to rotate the banknote picking rubber wheel, and a second one-way bearing 522 configure to assemble the banknote separating rubber wheel 521 and the banknote separating wheel shaft 523. The banknote separating rubber wheel 521 wraps the outer surface of the second one-way bearing 522, the banknote separating wheel shaft 523 passes through the center hole of the second one-way bearing 522, and the banknote separating rubber wheel 521 is freely rotatable in the banknote discharging direction. In addition, to ensure that the piece-by-piece separated banknote can be smoothly delivered out of the housing 1, preferably, the banknote separating mechanism 5 further includes a banknote conveying wheel 54 and a pinch roller 55 which are assembled in interference fit and configured to deliver out the piece-by-piece separated banknote. The banknote conveying wheel 54 and the pinch roller 55 are located on a side of the banknote separating wheel assembly 52 where the banknotes are discharged.

Reference is made to FIG. 5. The operation principle of the banknote separating mechanism 5 is illustrated in detail. When the banknote separating mechanism 5 starts to work, each group of wheels rotates in the direction shown by an arrow in the Figure. Firstly, the banknote picking wheel 511 generates a frictional driving force for the uppermost sheet of banknote 07 in the stack of banknotes to enable the banknote 07 to move between the banknote separating wheel assembly 52 and the reverse wheel 53. Further, the banknote separating rubber wheel 521 of the banknote separating wheel assembly 52 provides a frictional driving force for the banknote 07, to drive the banknote 07 to continue to move towards the banknote conveying wheel 54 and the pinch roller 55, meanwhile the reverse wheel 53 generates an opposite friction resistance to the banknotes except for the uppermost sheet of banknote, to separate the banknote 07 from other banknotes. Further, the banknote 07 is delivered out of the banknote separating mechanism by the pulling force of the banknote conveying wheel 54 and the pinch roller 55, thus the banknote separating mechanism completes a banknote separation. It is to be noted that, since the banknote separating rubber wheel 521 is installed on the banknote separating wheel shaft 523 via the one-way bearing 522, the banknote separating rubber wheel 521 may rotate freely on the banknote separating wheel shaft 523 in the banknote discharging direction. Therefore, when the banknote is between the banknote conveying wheel 54 and the pinch roller 55 and is delivered out by the pulling force of the banknote conveying wheel 54 and the pinch roller 55, the banknote separating rubber wheel 521 will not generate a sliding frictional resistance to the banknote 07, in this case, the partial rubber structure in the conventional technology is replaced, that the banknote separating wheel assembly uses a banknote separating wheel hub made of material with a low friction coefficient to reduce the frictional resistance generated when the banknote is pulled out of the banknote separating wheel assembly. Besides, with the above structure, it can convey the banknote 07 between the banknote conveying wheel 54 and the pinch roller 55 by performing inching control on the banknote separating wheel assembly 52 and the banknote picking wheel assembly 51, and then the banknote conveying wheel 54 and the pinch roller 55 will generate a pulling force to deliver the banknote 07 out of the banknote separating mechanism 5. After the banknote 07 is delivered out, the inching control of the banknote separating wheel assembly 52 and the banknote picking wheel assembly 51 is performed again, thus the banknote separating mechanism 5 may perform continuous banknote separation by repeating the above process. Therefore, the outer diameter of the banknote separating wheel assembly 52 is not restricted by the length of the banknote and can be designed smaller, and the space occupied by the banknote separating mechanism 5 is greatly reduced and the banknote dispenser has a small boundary dimension.

Figure 6:
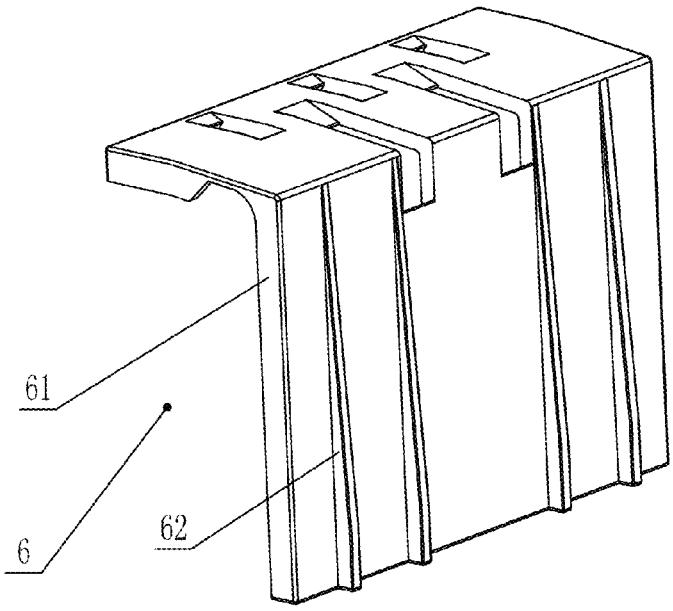
FIG. 6 is a schematic view showing the structure of a limiting block of the banknote dispenser in FIG. 3.

FIG. 6 shows the structure of a limiting block of the banknote dispenser in FIG. 3. The limiting block 6 is arranged on one end where the stack of banknotes is separated out and includes a limiting block body 61. A surface of a side of the limiting block body 61 near the whole stack of banknotes is provided with four guide ribs 62 arranged in the banknote stacking direction. A height of each guide rib 62 progressively decreases in a direction towards the banknote outlet. The four guide ribs 62 are uniformly distributed on the limiting block body 61.

Figure 7:
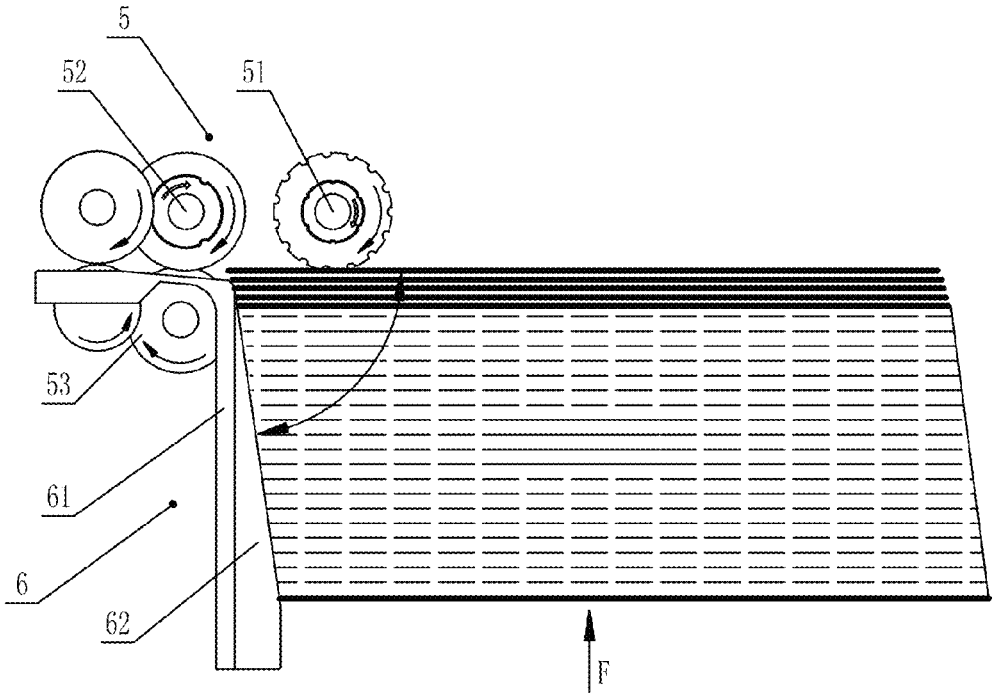
FIG. 7 is a schematic view showing the working state of the limiting block of the banknote dispenser in FIG. 3.

The operation state and effect of the limiting block 6 is illustrated in detail in conjunction with FIG. 7 hereinafter. As shown in FIG. 7, the limiting block 6 is placed between the reverse wheel 53 and the whole stack of banknotes, to align and guide the stack of banknotes. The limiting block 6 is designed with a group of guide ribs 62, and there are four guide ribs 62 in two groups in this embodiment. The guide ribs 62 extend in the banknote stacking direction and the height of each guide rib 62 is progressively reduced in the banknote stacking direction. With the above structure, the whole stack of banknotes previously with flush ends form an acute angle state due to the limiting of the guide ribs 62. The acute angle state of the whole stack of banknotes, on one hand, ensures that the first sheet of banknote near the banknote separating mechanism 5 is further forward than the second sheet of banknote so that the first sheet of banknote can be more easily separated out by the frictional driving force of the banknote separating wheel assembly 52, and on the other hand, forms a certain distance between the banknotes in the front back direction in advance by rubbing the banknotes against each other before the stack of banknotes are separated. The action of rubbing the banknotes against each other facilitates destroying the adhesion state caused by long-term squeezing between certain kinds of banknotes, especially for a stack of new banknotes, thereby enabling the whole stack of banknotes to be separated and discharged more easily. Hence, the limiting block 6 makes the whole stack of banknotes form an acute angle state, which facilitates separating the banknotes, before the stack of banknotes are separated, thus the banknote dispenser can realize a more effective and stable banknote separation.

Figure 8:
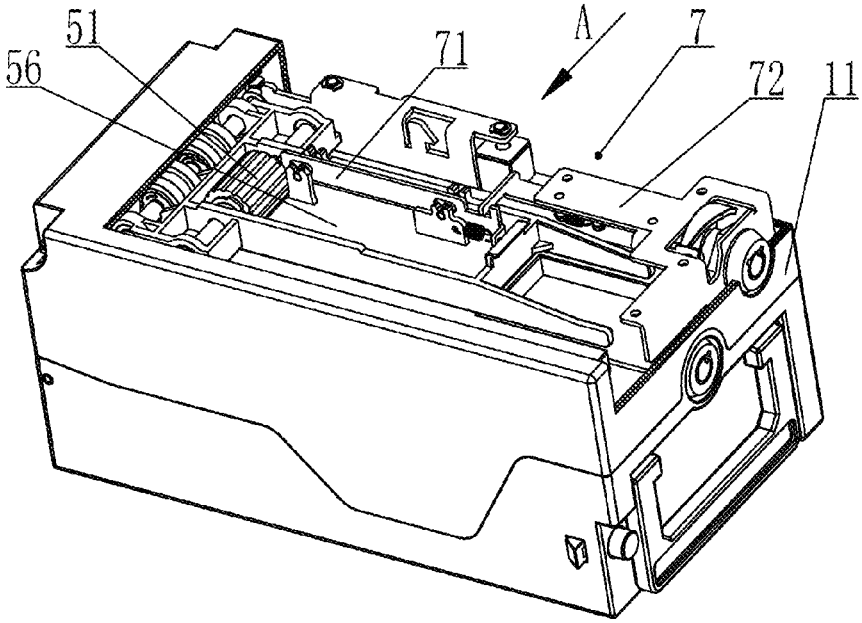
FIG. 8 is a schematic view showing the internal structure of the banknote dispenser in FIG. 1 by partially cutting the upper cover.
Figure 9:
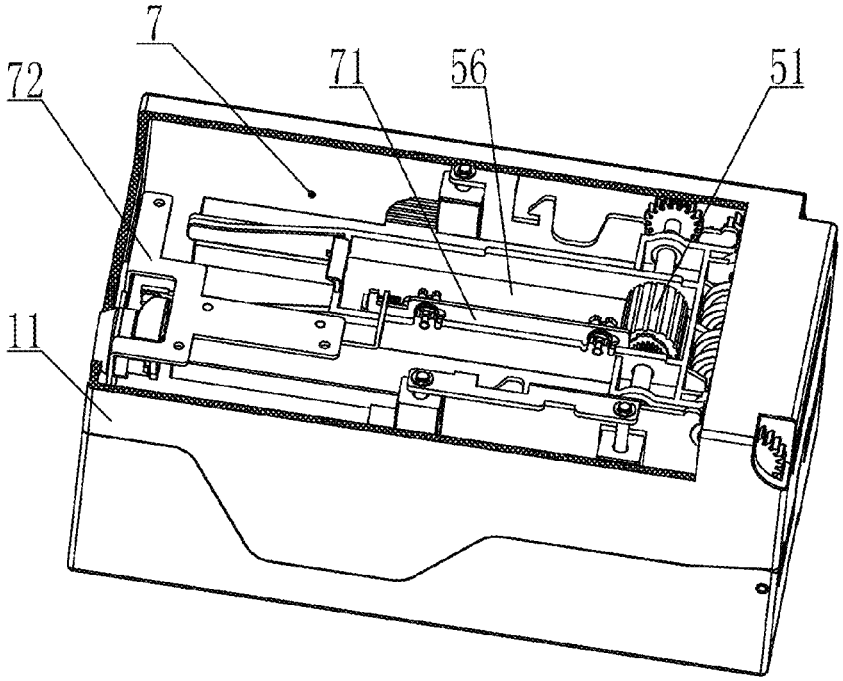
FIG. 9 is a schematic view showing the internal structure of the banknote dispenser viewed in the direction A in FIG. 8.
Figure 10:
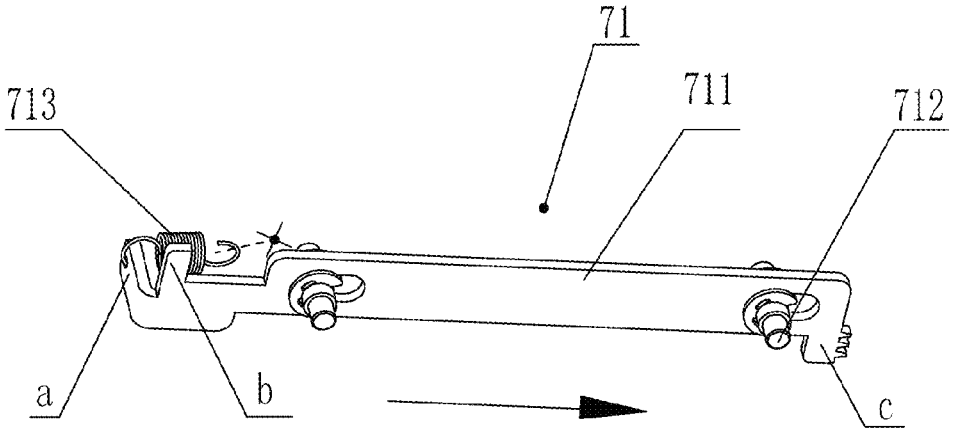
FIG. 10 is a perspective view showing a gear locking device of a locking mechanism of the banknote dispenser in FIG. 9.
Figure 11:
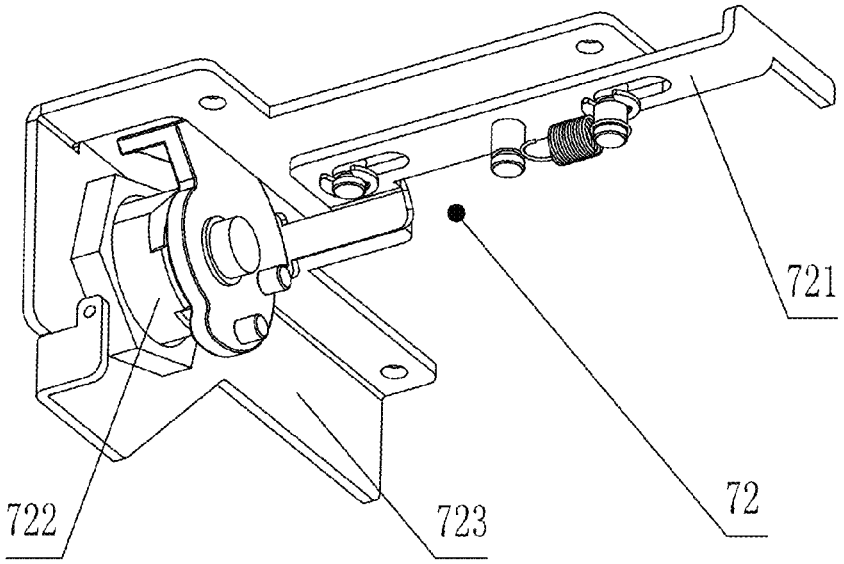
FIG. 11 is a perspective view showing a pulling device of the locking mechanism of the banknote dispenser in FIG. 9.

The banknote dispenser is a carrier of banknotes, thus the security of the management of the banknote dispenser is very important. It is generally required to install the banknote dispenser to related equipment before discharging banknotes; however in some occasions that the banknote dispenser is disengaged from the related equipment, such as in transportation and storage, the banknote dispenser cannot discharge banknotes. For meeting the above requirements, the banknote dispenser according to the present application is provided with a locking mechanism which is shown in FIG. 8. FIG. 8 is a schematic view showing the internal structure of the banknote dispenser in FIG. 1 by partially cutting the upper cover. FIG. 9 is a schematic view showing the internal structure of the banknote dispenser viewed in the direction A in FIG. 8. FIGS. 10 and 11 are schematic views showing the positions of main components of the locking mechanism 7 when the banknote dispenser is closed. The locking mechanism 7 includes a gear locking device 71 configured to selectively lock the banknote picking wheel assembly 51 and a pulling device 72 configured to control the gear locking device 71 to lock and unlock the banknote picking wheel assembly 51. The gear locking device 71 is mounted on a banknote separating base plate 56 connected to the banknote picking wheel assembly 51. The pulling device 72 is fixed to an inner side of the upper cover 11 via a bolt. As shown in FIG. 10, the gear locking device 71 includes an elongated gear locking sheet 711, and one end of the elongated gear locking sheet 711 is provided with a fastener c. The elongated gear locking sheet 711 is provided with an elongated hole acting as a stroke limiting hole, and the guide shaft 712 passes through the stroke limiting hole, thus the elongated gear locking sheet 711 is movably installed on the banknote separating base plate 56. The elongated gear locking sheet 711 keeps the engaging trend between the fastener c and the banknote picking mechanism through a gear locking tension spring 713. Specifically, the gear locking sheet 711 includes an extension arm a, a buckling arm b and the fastener c, and is limitedly mounted on the guide shaft 712 by a split washer. One end of the gear locking tension spring 713 is fastened to the extension arm a of the gear locking sheet 711, and another end of the gear locking tension spring 713 is fastened to a fixed point of the banknote separating base plate 56. When the gear locking device 71 is in a free state, the gear locking sheet 711 moves in the direction shown by an arrow in the figure by the pulling force of the gear locking tension spring 713.

Figure 12:
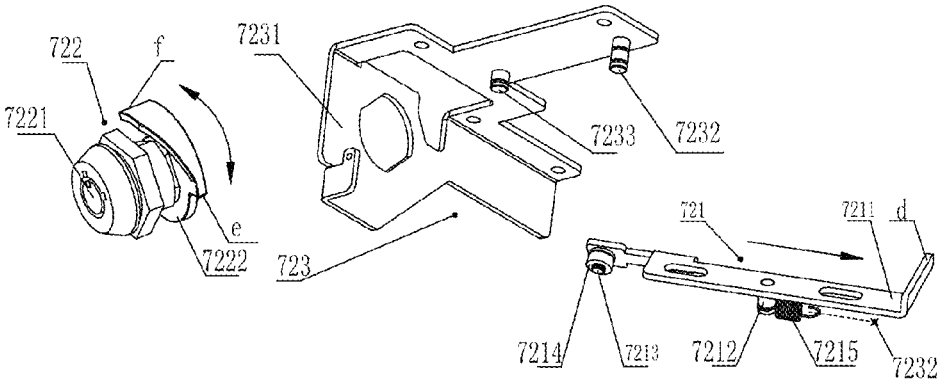
FIG. 12 is a perspective view showing three components of the pulling device of the locking mechanism of the banknote dispenser in FIG. 11.

The pulling device 72 of the locking mechanism is illustrated in conjunction with FIGS. 11 and 12. The pulling device includes a pull arm assembly 721 and a driving assembly 722. The pull arm assembly 721 includes an elongated pull arm 7211, one end of the pull arm 7211 is provided with a pull rod d configured to selectively contact the elongated gear locking sheet 711, and a bearing 7214 configured to be in a rolling contact with the driving assembly is arranged on another end of the pull arm 7211 via a small shaft 7213. Preferably, the elongated pull arm 7211 is provided with a tension spring 7215, and the tension spring 7215 has one end fixed to the elongated pull arm. In this embodiment, one end of the tension spring is fixed by a control pin 7212, and another end of the tension spring is relatively fixed to the housing 1. The pull arm assembly 721 is limitedly mounted on a fixing assembly 723 by a split washer, the driving assembly 722 is fastened to the fixing assembly 723 via a nut, and the pull arm assembly 721 is associated with the driving assembly 722. FIG. 12 is a perspective view showing three major components of the pulling device in FIG. 11. The pull arm assembly 721 includes the pull arm 7211, the control pin 7212, the small shaft 7213, the bearing 7214 and the pull arm tension spring 7215. The pull arm 7211 includes the pull rod d. The control pin 7212 and the small shaft 7213 are fixed to the pull arm 7211 by riveting. The bearing 7214 is sleeved on the small shaft 7213. One end of the pull arm tension spring 7215 is fastened to the control pin 7212 and another end of the pull arm tension spring 7215 is fastened to a long guide shaft 7232 of the fixing assembly 723. When the pull arm assembly 721 is in a free state, the pull arm 7211 moves in the direction shown by an arrow in the figure by the force of the pull arm tension spring 7215. The driving assembly 722 includes a security lock 7221 and a cam 7222.

The security lock 7221 can only be driven by the only one matched key. The cam 7222 is tightly fixed to the security lock 7221 by a bolt, and is designed with a boss structure. The boss has a lowest point e and a highest point f. The cam 7222 may rotate in the direction as shown by an arrow in the figure to switch the boss between the lowest point e and the highest point f. The fixing assembly 723 includes a fixing frame 7231, the long guide shaft 7232 and a short guide shaft 7233. The long guide shaft 7232 and the short guide shaft 7233 are fastened to the fixing frame 7231 by riveting.

Figure 13A:
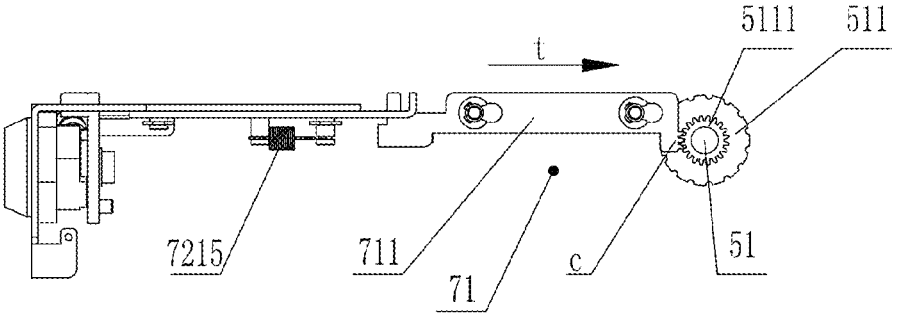
FIG. 13*a* is a two-dimensional front view showing a closed state of the locking device of the banknote dispenser in FIG. 9.
Figure 13B:
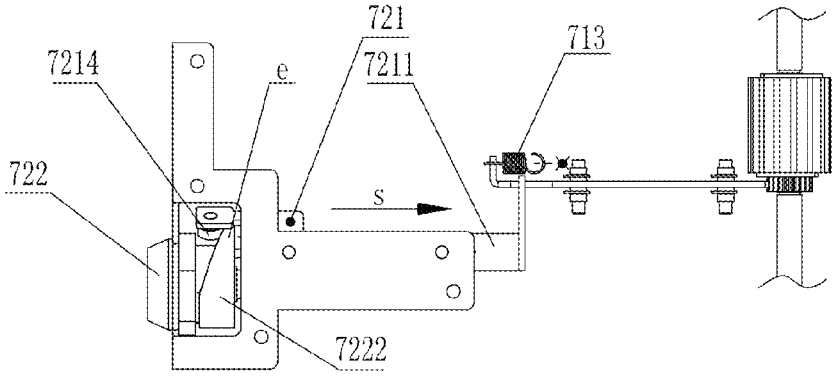
FIG. 13*b* is a two-dimensional top view showing the closed state of the locking device of the banknote dispenser in FIG. 9.

FIG. 13*a* and FIG. 13*b* are two-dimensional schematic views showing a closed state of the locking device of the banknote dispenser in FIG. 11. With the above structure, when the driving mechanism 722 is in a closed state, the cam 7222 associated with the bearing 7214 of the pull arm assembly 721 is at the lowest point e of the boss, and at this moment, the pull arm assembly 721 is in a free state, and the pull arm 7211 moves in the direction as shown by an arrow s in the figures under the action of the pulling force of the pull arm tension spring 7215 and stops moving until the bearing 7214 comes into contact with the boss of the cam 7222. Meanwhile, the gear locking device 71 is also in a free state, the gear locking sheet 711 moves in the direction shown by an arrow t in the figures under the action of the pulling force of the gear locking tension spring 713, and at this moment, the fastener c of the gear locking sheet 711 is inserted into a gear structure 5111 on one side of the banknote picking wheel 5111. It should be noted that, the gear structure 5111 is a part of the banknote picking wheel 511, and the gear structure 5111 and the banknote picking wheel 511 cannot move with respect to each other. Due to the interference of the fastener c of the gear locking sheet 711, the banknote picking wheel 511 cannot rotate, and the banknote separating mechanism cannot separate banknotes, thus the banknote dispenser cannot discharge banknotes.

Figure 14A:
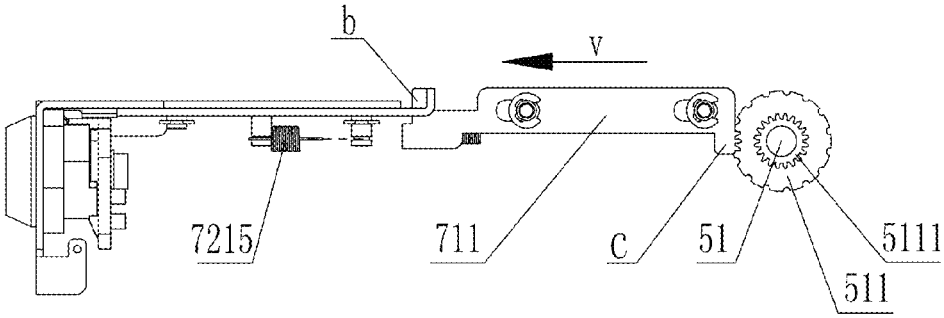
FIG. 14*a* is a two-dimensional front view showing an open state of the locking device of the banknote dispenser in FIG. 9.
Figure 14B:
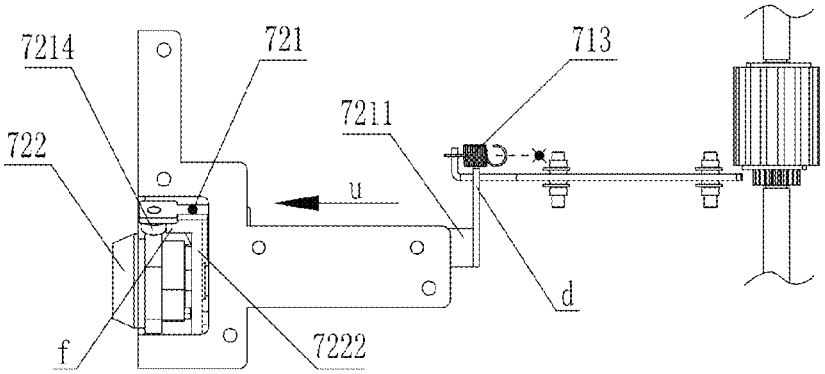
FIG. 14*b* is a two-dimensional top view showing the open state of the locking device of the banknote dispenser in FIG. 9.

FIG. 14*a* and FIG. 14*b* are two-dimensional schematic views showing an open state of the locking device of the banknote dispenser in FIG. 11. When the driving mechanism 722 rotates from the closed state to an open state, the cam 7222 associated with the bearing 7214 of the pull arm assembly 721 is switched from the lowest point e to the highest point f of the boss. At this moment, the bearing 7214 of the pull arm assembly 721 is subjected to a guiding force of the boss of the cam 7222, which makes the pull arm 7211 overcome the pulling force of the pull arm tension spring 7215 to move in the direction shown by an arrow u in the figures. Further, the pull rod d of the pull arm 7211 applies a pulling force on the buckling arm b of the gear locking sheet 711, which makes the gear locking device 711 overcome the pulling force of the gear locking tension spring 713 to move in the direction shown by an arrow v in the figures, thereby disengaging the fastener c of the gear locking sheet 711 from the gear structure 5111 of the banknote picking wheel 511. At this moment, the banknote picking wheel 511 is rotatable and the banknote separating mechanism can perform banknote separation, thereby allowing the banknote dispenser to be in a dischargeable state.

The banknote dispenser according to the present application has a locking mechanism, and the opening and closing of the locking mechanism 7 is realized by rotating the driving device 722. However, the rotating of the driving device 722 is controlled by the only one matched key, that is, whether the banknote dispenser according to the present application can discharge banknotes is only controlled by the person who has the only access to the key, in this way, the security of management of the banknote dispenser is greatly improved.

Banknote supplement is a general process in the daily operation of the banknote dispenser. When the banknote dispenser dispenses out all banknotes and is empty, the operator needs to supply the banknote dispenser with banknotes to ensure the banknote dispenser to operate normally. When supplementing the banknotes, the banknote pressing board needs to be pushed back to a certain position to free up a space for receiving the banknotes. In order to keep the banknote pressing board at that position to make it easy for the operator to supplement banknotes, a buckle is provided inside the banknote dispenser. The buckle is used to fasten the banknote pressing board, to enable the banknote pressing board to overcome the force of the spring to stay at the certain position. When the banknotes supplement is completed, the operator needs to press the buckle to disengage it from the banknote pressing board, then the banknote pressing board can restore to a normal operation state and apply a pushing force to the banknotes under the action of the spring force, to press the banknotes against the banknote separating mechanism. It should be noted that, if the banknote pressing board is in the fastened state, the banknote pressing board cannot provide a pushing force to the banknotes, and the banknotes cannot be pressed against the banknote separating mechanism, which directly causes the banknote separating mechanism to be unable to separate banknotes, and causes the banknote dispenser to fail to discharge banknotes. It is required to solve the problem, that a procedure of pressing the buckle manually is required to loose the banknote pressing board, and if the operator misses this procedure, the banknote pressing board will be still in the fastened state and cannot operate normally, which directly results in an invalid banknote separation of the banknote separating mechanism and the banknote dispenser being failing to dispense banknotes. Such banknote dispenser has a low operation reliability and a poor fault tolerance.

Figure 15:
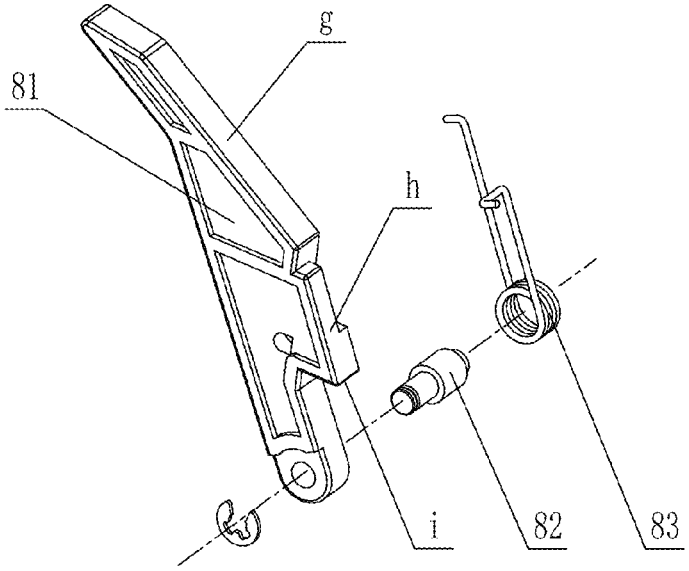
FIG. 15 is a perspective view showing a mistake-proof mechanism for a buckle of a banknote pressing board of the banknote dispenser in FIG. 2.

For solving the above problem, the banknote dispenser according to the present application includes a mistake-proof mechanism for the buckle of the banknote pressing board. FIG. 15 is a perspective view showing the mistake-proof mechanism 8 for the buckle of the banknote pressing board of the banknote dispenser in FIG. 2. The mistake-proof mechanism 8 for the buckle of the banknote pressing board includes a buckle 81 configured to retain the banknote pressing board at the lowest position of the base case. The buckle 81 is movably installed in the housing via a rotating shaft 82 and is provided with a torsion spring 83 configured to reset the buckle 81 automatically. Correspondingly, a buckle trigger mechanism is arranged on the upper cover at a position corresponding to the buckle 81, and accordingly, a retaining triangular portion L corresponding to the buckle is arranged on the banknote pressing board. The buckle trigger mechanism is embodied as a rib k that is arranged on the inner side wall of the upper cover 11 at a position corresponding to the buckle 81. Specifically, the buckle 81 includes a large slide surface g configured to allow the rib k to slide thereon, a small slide surface h configured to allow the banknote pressing board to slide thereon, and a hook i for retaining the banknote pressing board. The buckle 81 and the torsion spring 83 are sleeved on the rotating shaft 82, and the buckle 81 is rotatable around the rotating shaft 82.

Figure 16:
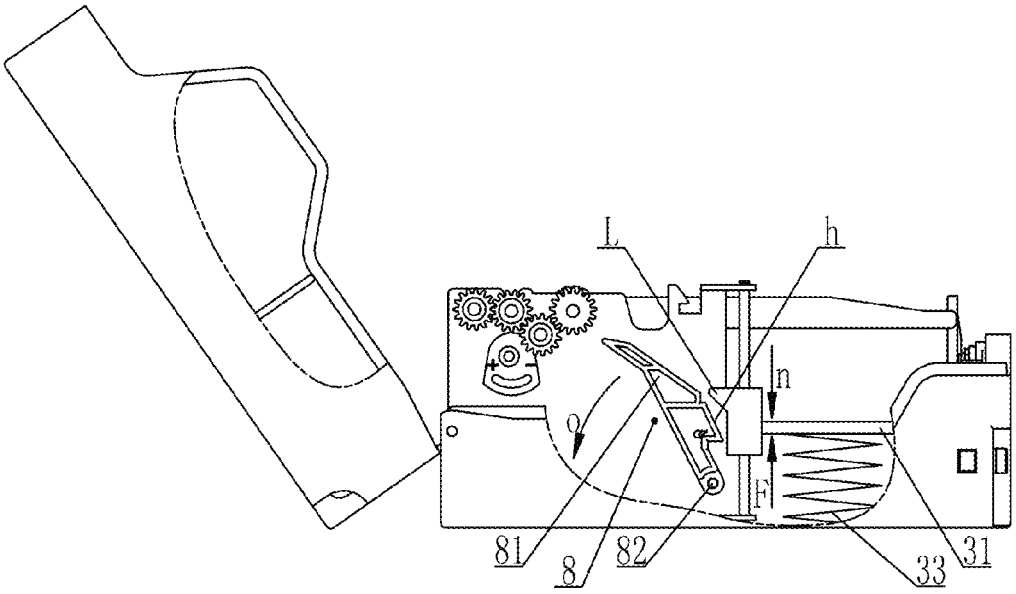
FIG. 16 is a schematic view showing an open state of the banknote dispenser before the banknote pressing board is fastened.
Figure 17:
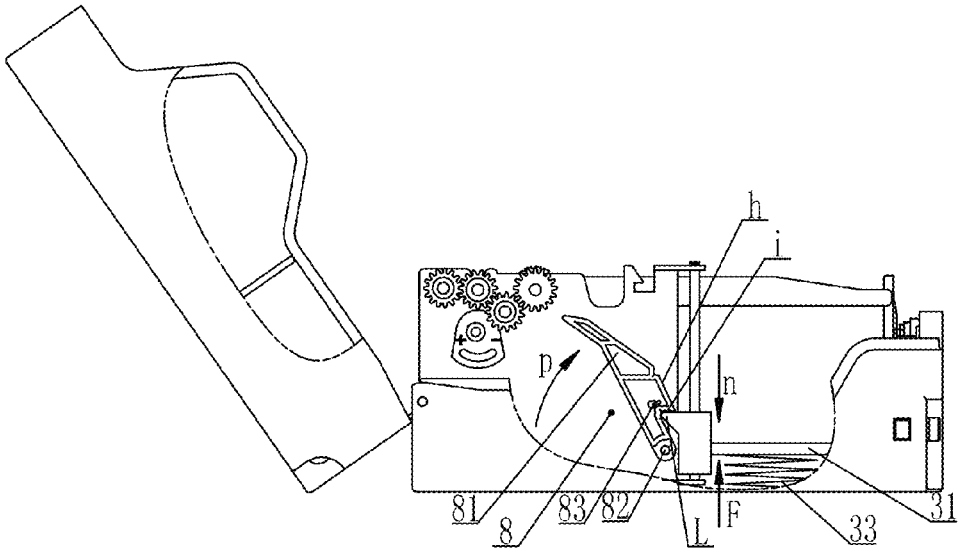
FIG. 17 is a schematic view showing the open state of the banknote dispenser when the banknote pressing board is fastened.
Figure 18:
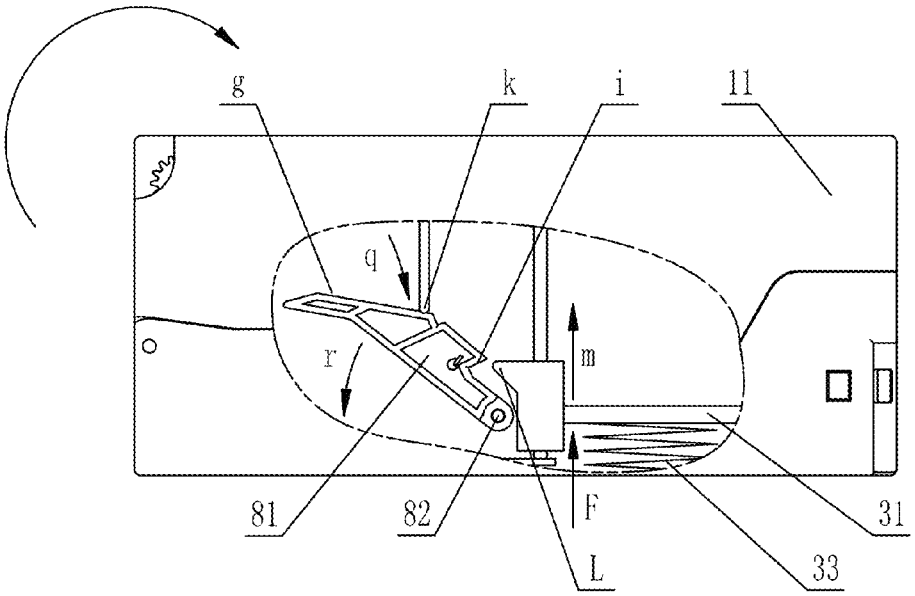
FIG. 18 is a schematic view showing the closed state of the banknote dispenser when the banknote pressing board is unfastened.

The operation principle of the mistake-proof mechanism for the buckle of the banknote pressing banknote is further illustrated herein in conjunction with FIGS. 16 to 18. Reference is made to FIG. 16, which is a schematic view showing the state of the banknote pressing board 31 before being fastened. The operator pushes the banknote pressing board 31 in the direction shown by an arrow n in the figures before supplementing banknotes. The banknote pressing board 31 overcomes the spring force of the banknote pressing spring 33 to move in the direction shown by the arrow n. The triangular portion L of the banknote pressing board 31 comes into contact with the small slide surface h of the buckle 81 and drives the buckle 81 to rotate around the rotating shaft 82 in the direction shown by an arrow o in the figures.

Furthermore, as shown in FIG. 17, the banknote pressing board 31 continues to move in the direction shown by the arrow n in the figures until the triangular portion L is disengaged from the small slide surface h of the buckle 81. The buckle 81 rotates in the direction shown by an arrow p in the figures by the torsion of the torsion spring 83 and the hook i of the buckle 81 is retained by the triangular portion L of the banknote pressing board 31, thereby fastening the banknote pressing board.

Furthermore, as shown in FIG. 18, the operator closes the upper cover 11 of the housing after banknotes supplement is completed. The rib k of the upper cover 11 rotates in the direction shown by an arrow q in the figure along with the closing of the upper cover 11, and comes into contact with the large slide surface g of the buckle 81 and drives the buckle 81 to rotate around the rotating shaft 82 in the direction shown by an arrow r in the figure. The hook i of the buckle 81 is already disengaged from the triangular portion L of the banknote pressing board 31 when the upper cover 11 is closed in place. Then, the banknote pressing board 31 moves in the direction shown by an arrow m in the figure by the spring force of the banknote pressing spring 33, and is restored to a normal operation state to generate a pushing force on the banknotes. With the above structure, after the banknote supplement is completed, the operator only needs to close the upper cover 11 of the housing, and when the upper cover 11 is closed, the buckle 81 is rotated to be disengaged from the banknote pressing board 31, thus the banknote pressing board 31 is loosened and restored to the normal operation state, thereby avoiding the problem that the banknote pressing board is always in the fastened state and fails to operate normally in the case that the operator misses the procedure of pressing the buckle. The banknote dispenser according to the present application has a high operation reliability and a good fault tolerance.

The embodiments described hereinabove are only specific implementations of the present application, and the scope of the present application is not limited to this. It is obvious for the person skilled in the art to make a few of changes and replacements based on the technical scope disclosed by the present application, and these changes and replacements are also deemed to fall into the scope of the present application. Therefore, the scope of the present application is defined by the claims.

The invention claimed is:

1. A banknote dispenser, comprising:

a housing, comprising an upper cover and a base case, one end of the upper cover being movably connected to one end of the base case via a rotating shaft, and a space for accommodating other components and banknotes being formed in the case that the upper cover is closed on the base case, and the housing being provided with a banknote outlet for discharging the banknotes;

a banknote separating mechanism located near the banknote outlet, and comprising a banknote picking wheel assembly configured to be placed on a surface of the banknotes, a banknote separating wheel assembly and a reverse wheel which are configured to be placed at an end of the banknotes and to separate a stack of banknotes individually, and a banknote separating base plate configured to install required components, wherein the banknote picking wheel assembly comprises a banknote picking wheel having a rubber surface, a banknote picking wheel shaft configured to rotate the banknote picking wheel, and a first one-way bearing configured to assemble the banknote picking wheel and the banknote picking wheel shaft, and the banknote separating wheel assembly comprises a banknote separating rubber wheel in an interference fit with the reverse wheel, a banknote separating wheel shaft configured to rotate the banknote separating rubber wheel, and a second one-way bearing configured to assemble the banknote separating rubber wheel and the banknote separating wheel shaft;

a banknote pressing mechanism, comprising a banknote pressing board placed in the base case and configured to stack up the stack of banknotes, a guide shaft of the banknote pressing board, and a banknote pressing spring configured to enable the banknote pressing board to always press against the banknote picking wheel assembly of the banknote separating mechanism; and a limiting block, arranged on one end where the stack of banknotes is separated out, at least a guide rib being provided on a surface of the limiting block in a banknote stacking direction, and a height of the guide rib being decreased progressively in the direction towards the banknote outlet.

2. The banknote dispenser according to claim 1, further comprising a mistake-proof mechanism for a buckle of the banknote pressing board, which comprises a buckle configured to retain the banknote pressing board at the lowest position of the base case, and the buckle is movably installed in the housing via a rotating shaft and is provided with a torsion spring configured to allow the buckle to reset automatically.

3. The banknote dispenser according to claim 2, wherein a buckle trigger mechanism is arranged on the upper cover at a position corresponding to the buckle.

4. The banknote dispenser according to claim 3, wherein the buckle trigger mechanism comprises a rib arranged on an inner side wall of the upper cover at a position corresponding to the buckle.

5. The banknote dispenser according to claim 1, wherein the banknote separating mechanism further comprises a locking mechanism, the locking mechanism comprises a gear locking device configured to selectively lock the banknote picking wheel assembly, and a pulling device configured to control the gear locking device to lock and unlock the banknote picking wheel, the gear locking device comprises an elongated gear locking sheet, fastener is provided at an end of the elongated gear locking sheet, and the elongated gear locking sheet is provided with an elongated hole acting as a stroke limiting hole for the elongated gear locking sheet, the guide shaft passes through the stroke limiting hole to movably assemble the elongated gear locking sheet and the banknote separating base plate, and the elongated gear locking sheet is configured to keep the engaging trend between the fastener and the banknote picking mechanism through a gear locking tension spring.

6. The banknote dispenser according to claim 5, wherein the pulling device comprises a pull arm assembly and a driving assembly, the pull arm assembly comprises an elongated pull arm, one end of the elongated pull arm is provided with a pull rod in selective contact with the elongated gear locking sheet, and a bearing in rolling contact with the driving assembly is provided at another end of the elongated pull arm via a small shaft.

7. The banknote dispenser according to claim 6, wherein the driving assembly comprises a lock cylinder relatively fixed to the housing, and a cam configured to rotate together with the lock cylinder, an arc-shaped boss is provided on an outer surface of the cam, the arc-shaped boss has one point with a maximum radius and another point with a minimum radius, and the lock cylinder is configured to drive the cam to rotate, to make the bearing move reciprocally between the point with the maximum radius and the point with the minimum radius of the boss.

8. The banknote dispenser according to claim 6, wherein the elongated pull arm is provided with a tension spring, and the tension spring has one end fixed to the elongated pull arm, and another end relatively fixed to the housing.

9. The banknote dispenser according to claim 1, wherein an upper cover locking mechanism is arranged on one end of the upper cover where the upper cover engages with or disengages from the base case, and is configured to lock the upper cover and the base case and to maintain the upper cover and the base case as a whole.

10. The banknote dispenser according to claim 1, wherein the banknote separating mechanism further comprises a banknote conveying wheel and a pinch roller which are assembled in interference fit and configured to deliver out the individually separated banknote, and the banknote conveying wheel and the pinch roller are located on one side of the banknote separating wheel assembly where the banknotes are delivered out.

* * * * *